US008272094B2

(12) United States Patent
Stein et al.

(10) Patent No.: US 8,272,094 B2
(45) Date of Patent: Sep. 25, 2012

(54) FLOOR CARE DISK

(75) Inventors: Klaus Stein, Velbert (DE); Bernd Falkenstein, Wuppertal (DE)

(73) Assignee: Stein & Co. GmbH, Velbert (DE)

( * ) Notice: Subject to any disclaimer, the term of this patent is extended or adjusted under 35 U.S.C. 154(b) by 472 days.

(21) Appl. No.: 12/590,953

(22) Filed: Nov. 16, 2009

(65) Prior Publication Data

US 2010/0125966 A1 May 27, 2010

(30) Foreign Application Priority Data

Nov. 25, 2008 (DE) ..... 10 2008 060 100

(51) Int. Cl.
*A47L 11/14* (2006.01)

(52) U.S. Cl. ..... 15/230; 451/353

(58) Field of Classification Search ..... 15/180, 15/230, 230.17, 230.18, 230.19; 451/353, 451/359, 495
See application file for complete search history.

(56) References Cited

U.S. PATENT DOCUMENTS

| | | | | |
|---|---|---|---|---|
| 2,242,577 | A * | 5/1941 | Finnell | 15/180 |
| 2,713,757 | A * | 7/1955 | Brennecke | 451/353 |
| 3,550,179 | A * | 12/1970 | Brown et al. | 15/230 |
| 4,709,439 | A * | 12/1987 | Warren et al. | 15/230.16 |
| 6,638,151 | B2 * | 10/2003 | Ueno | 451/359 |

FOREIGN PATENT DOCUMENTS

WO 93/08955 * 5/1993

* cited by examiner

*Primary Examiner* — Mark Spisich
(74) *Attorney, Agent, or Firm* — W. F. Fasse

(57) ABSTRACT

A floor care disk for a floor care machine such as a floor polishing machine includes a floor care pad mounted on a drive plate. The drive plate includes a stiff disk element and tongue-like tabs connected flexibly to a radially outer portion or rim of the disk element, and extending radially inwardly toward a radially inner portion or hub of the disk element. The radially inner free ends of the tongue-like tabs are free to flexibly deflect away from the plane of the disk element. The pad is mounted on the tabs and on the radially outer portion of the disk element. During rotational operation of the floor care disk, due to the arising centrifugal force acting on the center of mass of the rotating pad and tongue-like tabs, the pad and the tongue-like tabs are flexibly deflected away from the disk element and toward the floor surface, thereby deflecting the pad into osculating contact with the floor surface.

16 Claims, 5 Drawing Sheets

FLOOR CARE DISK

PRIORITY CLAIM

This application is based on and claims the priority under 35 U.S.C. §119 of German Patent Application 10 2008 060 100.4, filed on Nov. 25, 2008, the entire disclosure of which is incorporated herein by reference.

FIELD OF THE INVENTION

The invention relates to a floor care disk for a floor care machine, such as a floor polishing machine, especially a high speed floor care machine. The machine includes a frame and a rotational drive including a rotational drive spindle or arbor to which the floor care disk can be mounted, and the machine is movably supported on a floor that is to be polished or otherwise treated by the floor care machine. The floor care disk includes a drive plate in the form of a disk as a carrier platform on the underside of which one or more floor care pads are mounted for contacting and polishing or otherwise treating the floor.

BACKGROUND INFORMATION

Conventionally known floor care disks for floor polishing machines or other floor care machines generally comprise a drive plate or disk that is rotatably mounted on the floor care machine and that serves as a carrier for receiving a polishing disk, or a cleaning disk, or some other floor treatment disk. Such known drive plates or disks are generally very stiff and are flange-connected in a removable or releasable manner on a drive spindle or arbor of a rotational drive unit of the floor care machine. The floor treatment disk forms a stable platform for receiving and carrying one or more floor care pads that contact and thereby polish, clean or otherwise treat the floor surface. These floor care pads are generally flexible and deformable.

It is further known to provide less-stiff drive plates for high-speed floor care machines that operate with a very high rotational speed of the floor care disk. Such machines mostly have the rotation axis of the drive plate thereof tilted slightly forwardly in the range from 0.5° to 4° relative to vertical. Therefore, with such a forwardly tilted rotation axis, the floor care pad mounted on the drive plate theoretically contacts the floor at only a single point at the forward edge or circumferential rim of the pad, but in actual practical application the pad contacts the floor surface along a circular segment, due to flexing or deflection of the pad and/or the somewhat flexible drive plate. Such flexing or deformation of the drive plate improves the contacting osculation of the pad onto the floor surface to be treated. While such flexing or deformation of the pad and drive plate to smoothly lie in contact on the floor surface is simple while the machine is at rest, i.e. not operating, the smooth osculating contact of the pad on the floor surface is hindered or made more difficult during fast rotation of the drive plate of the operating floor care machine. Namely, the particular dynamics of the fast-rotating drive plate, in consideration of the stiffness characteristics of the deformable structure represented by the pad, the floor treatment carrier disk, and the drive plate, gives rise to flexing or deformation effects that are difficult to control and maintain in a consistent manner. Thus, the mass distribution of the drive plate and the pad mounted thereon, as well as the particular pressure loading applied through the machine onto the floor surface, can lead to the drive plate pitching or bucking or deflecting in a corrugated manner, whereby the drive plate, the floor treatment carrier disk, and/or the floor treatment pad deflect away from the floor surface that is to be treated. This occurs especially in the largest diameter range, and therefore it is possible that the desired floor contact and floor treatment effect cannot be achieved over the actual working width range of the pad. This may also lead to damage of the machine and of the floor surface that is to be treated.

SUMMARY OF THE INVENTION

In view of the above, it is an object of the invention to provide a floor care disk for a floor care machine such as a floor polishing machine, whereby this floor care disk is improved in a simple manner to achieve a good osculating contact of the floor care pad onto the floor surface that is to be treated, and to achieve a consistent reproducible floor treatment result. The invention further aims to provide such a floor care disk with a construction that is simple, durable and economical. The invention further aims to avoid or overcome the disadvantages of the prior art, and to achieve additional advantages as apparent from the present specification. The attainment of these objects is, however, not a required limitation of the claimed invention.

The above objects have been achieved according to the invention in a floor care disk for a floor care machine that includes a frame and a rotatable drive, and that is movably supported on the floor surface that is to be treated. According to the invention, is the floor care disk comprises a drive plate that includes a relatively stiff disk element and tongue-like surface elements or radially extending tabs that extend radially inwardly from a radially outer region to a radially inner region of the disk element and that are flexibly connected to the disk element through a flexible hinge-like connection in the outer diameter region of the disk element. Particularly, the tongue-like surface elements or radially extending tabs are arranged so as to allow the tongue-like tabs to bend or deflect outwardly away from the disk element, particularly in a direction downwardly toward the floor surface, during rotational operation of the floor care disk on the floor care machine. The floor care disk may further comprise at least one floor care pad mounted or mountable on the bottom of the tongue-like tabs and the outer region of the disk element.

With such a construction, the floor care disk includes a relatively stiff disk element that achieves advantages of a stiff drive plate (e.g. avoiding uncontrollable flexing, curving, pitching, or bucking of the drive plate), and further includes flexibly deformable or deflectable tongue-like tabs that provide advantageous characteristics of a flexible or soft drive plate (e.g. the flexible osculating adaptation of the drive plate and the pad onto the floor surface that is to be treated). The terms "tongue-shaped" or "tongue-like" refer to any shape or configuration that generally has an unconnected free end opposite a connected end, and may further have unconnected free side edges extending from the connected end to the free end. The terms "stiff" and "relatively stiff" means that the disk element is stiffer than the tongue-like tabs, and sufficiently stiff to maintain a controlled or controllable shape during rotation. The terms "flexible" and "relatively flexible" mean that the tongue-like tabs, or at least the flexible connections, are more flexible than the disk element, and sufficiently flexible to enable an outward deflection due to the centrifugal force acting on the tabs and the pad during rotational operation as disclosed herein. The "flexible connection" may simply be a flexible base end portion of the respective flexible tab, or may be a flexible connection portion that has greater flexibility than the body of the tongue-like tab.

The bending or flexing of the tongue-like tabs will always be directed toward the side or surface of the tab facing the floor surface that is to be treated, because the common center of mass of the deformable tongue-like tab and the pad portion mounted thereon will always lie on the side of the drive plate facing toward the pad, i.e. toward the floor surface, and will be located axially offset away from the planar surface of the disk element and particularly the plane at which the tongue-like tabs are flexibly attached to the stiff disk element. Therefore, as the floor care disk rotates during operation, the centrifugal force acting on the common center of mass of the pad on the tongue-like tabs will tend to pull the pads radially outwardly. This radially outwardly directed centrifugal force acting on the center of mass creates a bending moment on a lever arm relative is to the flexible attachment of the tongue-like tabs onto the stiff disk element, with a force component directed away from the disk element toward the floor surface as well as a radially outwardly directed force component. Therefore the mass of the pad and the tongue-like tabs, acted on by the centrifugal force, will deflect the tongue-like tabs and the tab mounted thereon in a direction away from the stiff disk element and toward the floor surface. The faster the rotation of the floor care disk, the stronger will be the deflecting force that tends to push the pad toward and into contact with the floor surface. Therefore also, the pad will be deflected or deformed in a flexible manner at the edge region of the tongue-like tabs, in order to adapt to the flexible deflection path of the tongue-like tabs. As a result, a good, smooth osculating contact and adaptation of the tab onto the floor surface to be treated will be achieved in the area or region of the tongue-like tabs and especially the free edge region of the tongue-like tabs. The terms "radial" and "radially" herein refer to the directions extending radially relative to a central axis of the floor care disk corresponding to a rotation axis of the drive shaft, spindle or arbor of the floor care machine. The terms "axial" and "axially" refer to a direction parallel to the central axis of the floor care disk corresponding to the rotation axis of the drive shaft, spindle or arbor of the floor care machine.

Further according to a preferred embodiment feature of the invention, it is suggested that the flexible connection or attachment of the tongue-like tabs onto the relatively stiff disk element is a tangential hinge-like connection, i.e. with a hinge is pivot axis extending tangentially to a circumferential direction. Preferably, this tangential or circumferential hinge-like connection is a flexible material hinge, preferably formed by the integral continuous one-piece material of the tongue-like tab and the disk element. This is preferably achieved by a step-like or tapering reduced material thickness at a transition from the outer region of the disk element to the tongue-like tabs. The entire tongue-like tab and the flexible hinge portion may have a uniform constant material thickness that is thinner than the thickness of the disk element, or the hinge portion may be thinner than the tongue-like tab and/or the disk element. Alternatively, the tongue-like tabs and/or the flexible hinge portions can be made of at least one more-flexible material relative to the material of the disk element. Particularly, at least the tongue-like tabs are preferably made of an elastically deformable synthetic plastic material. The disk element may be made of the same material, as one integral piece together with the tongue-like tabs. Alternatively, the tabs and the disk element may be made of different materials, or the tabs and the disk element may be made of one material and the flexible hinge connections therebetween can be made of a different (more-flexible) material. Other materials of which the disk element and/or the tongue-like tabs and/or the hinge connections can be made include various plastics, fiber reinforced composite materials, filler loaded composite materials, lightweight metals such as aluminum alloys, and others.

According to a further preferred detail of the invention, the is floor care pad is mounted on the drive plate particularly on the tongue-like tabs as well as on the outer diameter range or rim portion of the disk element. In this regard, the floor care pad preferably has an annular ring shape with a circular open center.

The disk element can have a spoked-wheel configuration including a central hub, a radially outer circular rim portion, and radially extending spoke portions that interconnect and extend between the hub and the rim portion. Another way to consider this configuration, is that the disk element has cut-outs or cut-out openings between the radially inner portion and the radially outer portion of the disk element, whereby these cut-outs leave spoke-like portions between successive cut-outs in the circumferential direction, whereby these spoke-like portions interconnect the radially inner region and the radially outer region of the disk element. The term "cut-out" does not require that the missing material of the "cut-out opening" or of the "cut-out" was removed by cutting. Rather the term encompasses all openings or holes produced in any manner, e.g. holes or void spaces left vacant from the beginning during casting or molding of the disk element or drive plate.

Furthermore, the tongue-like tabs can be arranged and received in the cut-outs, i.e. circumferentially between the successive spokes. It is further advantageous if the tongue-like tabs are respectively arranged in the cut-out openings of the disk element, while leaving a free space gap between free edges of the tongue-like tab and bounding edges of the cut-out opening. Particularly, this free space gap extends around three free edge sides of each tongue-like tab, while the radially outer fourth side of the tongue-like tab is defined by the connected base edge thereof that is connected to the disk element via the flexible hinge connection.

Alternatively, the disk element can have a substantially closed solid disk shape, and the tongue-like tabs are flexibly connected onto the outer region of the disk element such that the tongue-like tabs are arranged below or offset from the surface plane of the disk element on a side thereof oriented toward the floor surface. Namely, in this regard the tabs may preferably extend on a plane parallel to and spaced from the plane of the disk element.

A good functionality of the inventive floor care disk is achieved especially if the tongue-like tabs each have a trapezoidal shape with a circumferentially wider end at the radially outer hinge-connected end, and a circumferentially narrower end at the radially inner free end.

BRIEF DESCRIPTION OF THE DRAWINGS

In order that the invention may be clearly understood, it will now be described in connection with an example embodiment thereof, with reference to the accompanying drawings, wherein.

DETAILED DESCRIPTION OF A PREFERRED EXAMPLE EMBODIMENT OF THE INVENTION

Figure 1:
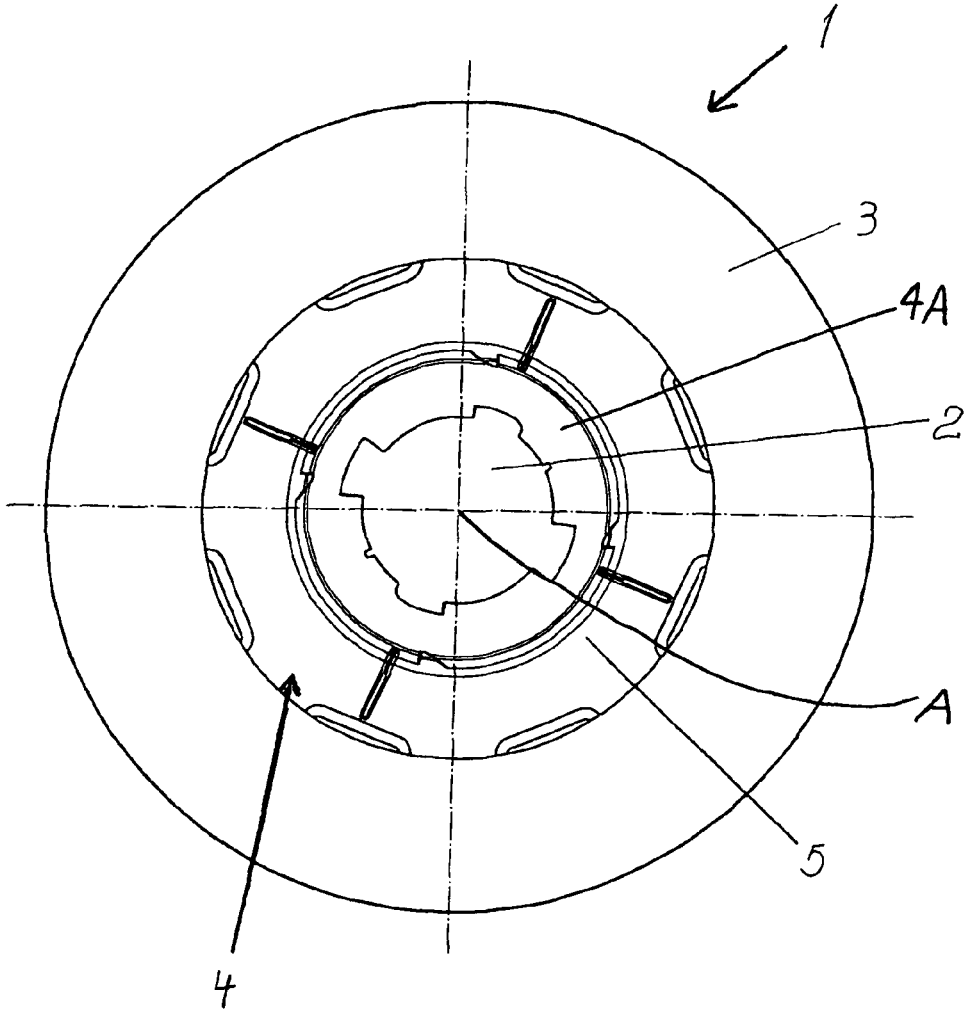
FIG. 1 is a bottom plan view of the bottom side of a floor care disk according to the invention.
Figure 2:
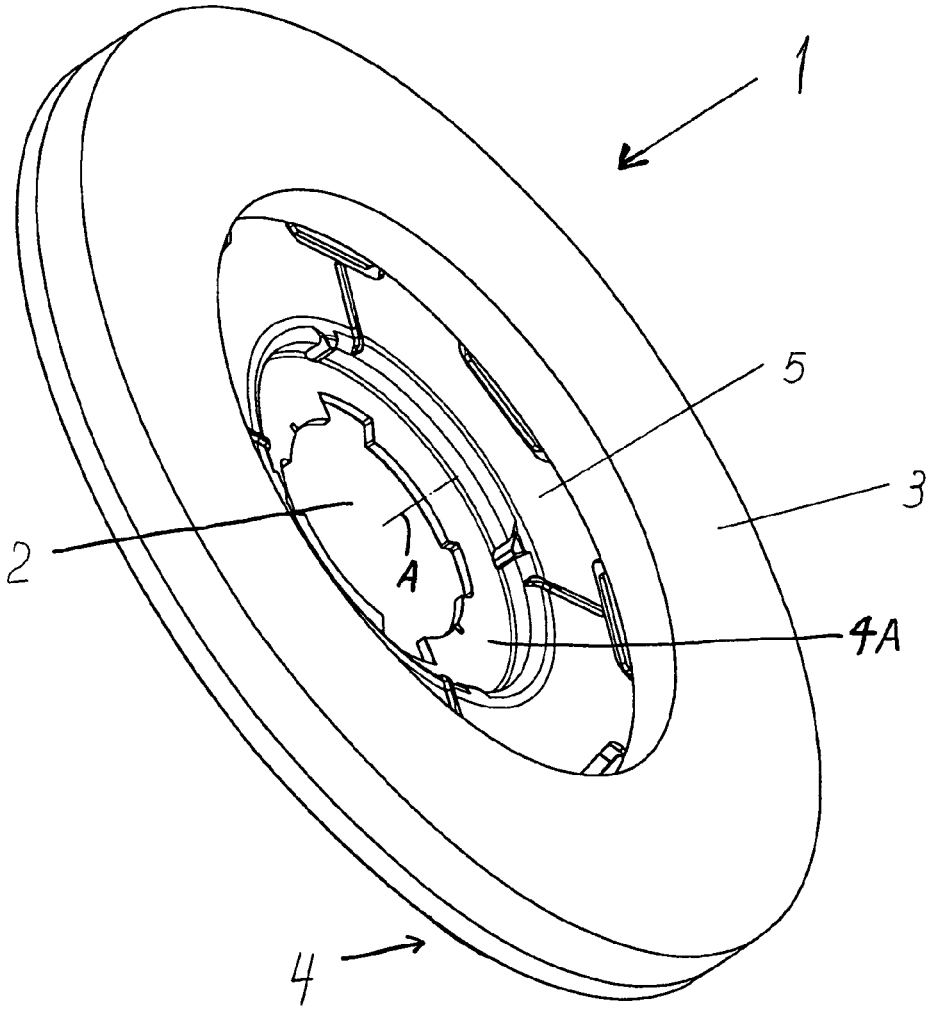
FIG. 2 is a perspective view of the bottom side of the floor is care disk according to FIG. 1.
Figure 3:
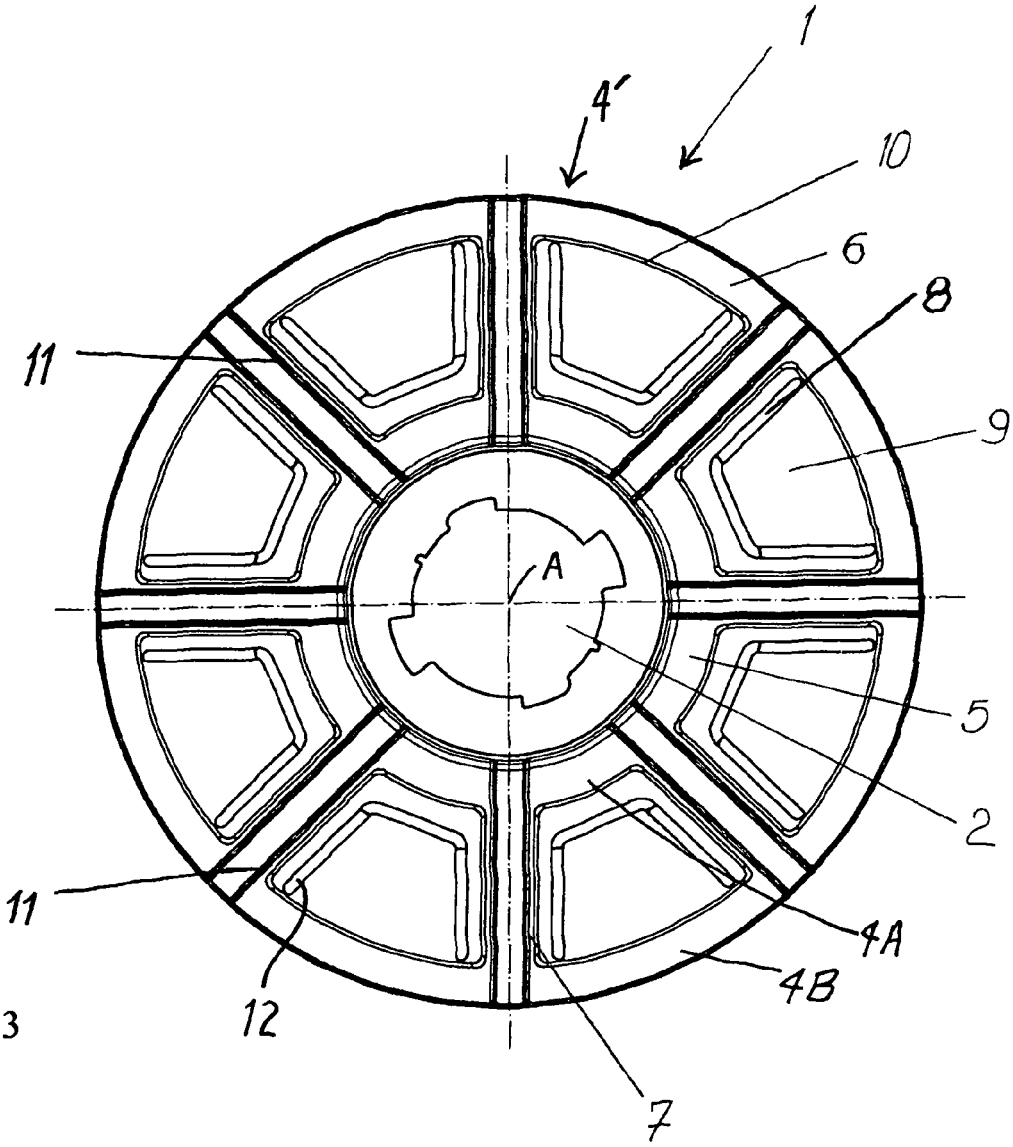
FIG. 3 is a top plan view of the top side of the floor care disk.
Figure 4:
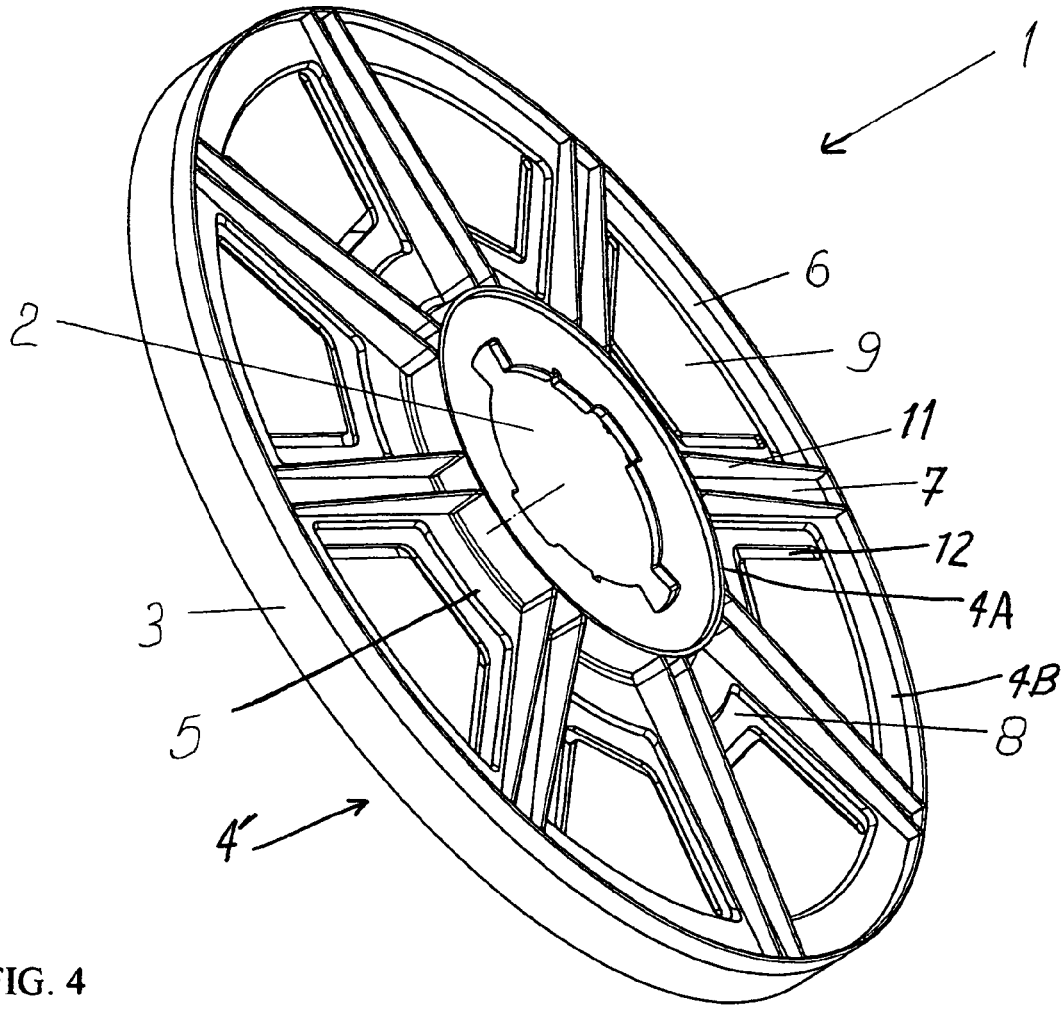
FIG. 4 is a perspective view of the top side of the floor care disk according to FIG. 3.

The preferred example embodiment of an inventive floor care disk 1 illustrated in the drawings generally comprises a drive plate 4' with a generally circular disk or wheel shape, and a floor care pad 3 that is mounted or mountable on the drive plate 4'. The drive plate 4' includes a relatively stiff disk is element 4 as well as a plurality of relatively flexible tongue-like surface elements or tabs 9 flexibly connected to the disk element 4 as will be described further below. In the present embodiment, the floor care disk 1 includes eight of such tongue-like tabs 9, but the number of the tongue-like tabs is not fixed or limited.

The disk element 4 includes a radially inner region 5 comprising a central hub 4A, and a radially outer region 6 comprising a circular rim 4B which are connected together by radially extending continuous spoke portions 7. The radially continuous spoke portions 7 are preferably additionally stiffened by stiffening ribs 11 extending radially along the spokes 7. The central hub 4A or radially inner region 5 has a mounting opening 2 that is configured to be mounted on a drive axle, shaft stub, spindle or arbor defining a central rotation axis A of a rotational drive arrangement of a floor care machine, which is not shown but may have any conventionally known construction and operation.

Circumferentially between the successive spoke portions 7, the disk element 4 has plural cut-out openings or cut-outs 8 that each have a trapezoidal truncated sector or pie-wedge shape, and that are distributed about the circumference of the disk element 4. In this embodiment, there are eight of the cut-outs 8, which respectively receive the eight tongue-like tabs 9 therein, circumferentially between the successive spoke portions 7 and radially between the radially inner region 5 and the radially outer region 6 of the disk element 4.

Figure 5:
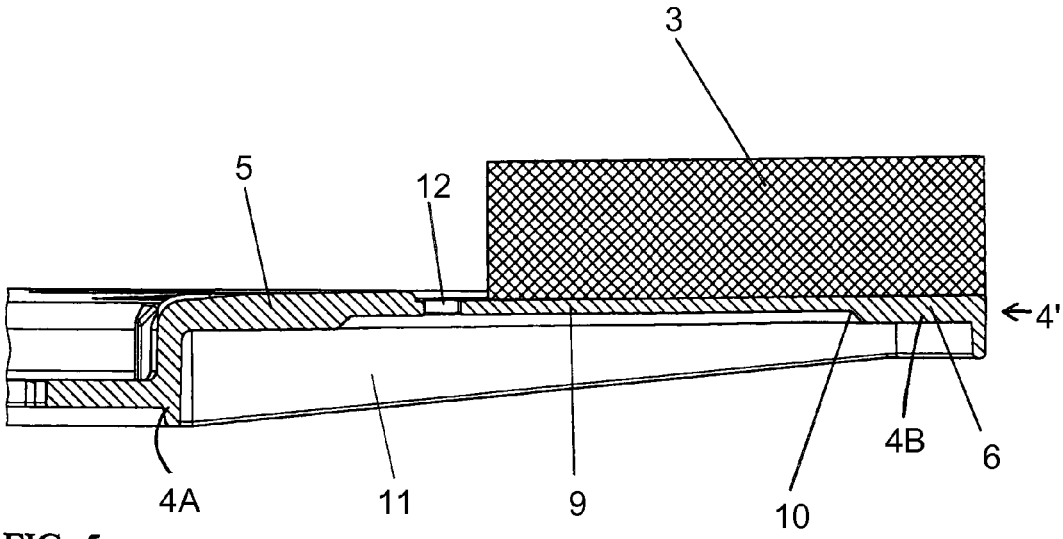
FIG. 5 is a sectional view of a portion of the floor care disk on an enlarged scale, with a pad and tongue-like tab in a non-operating rest position.
Figure 6:
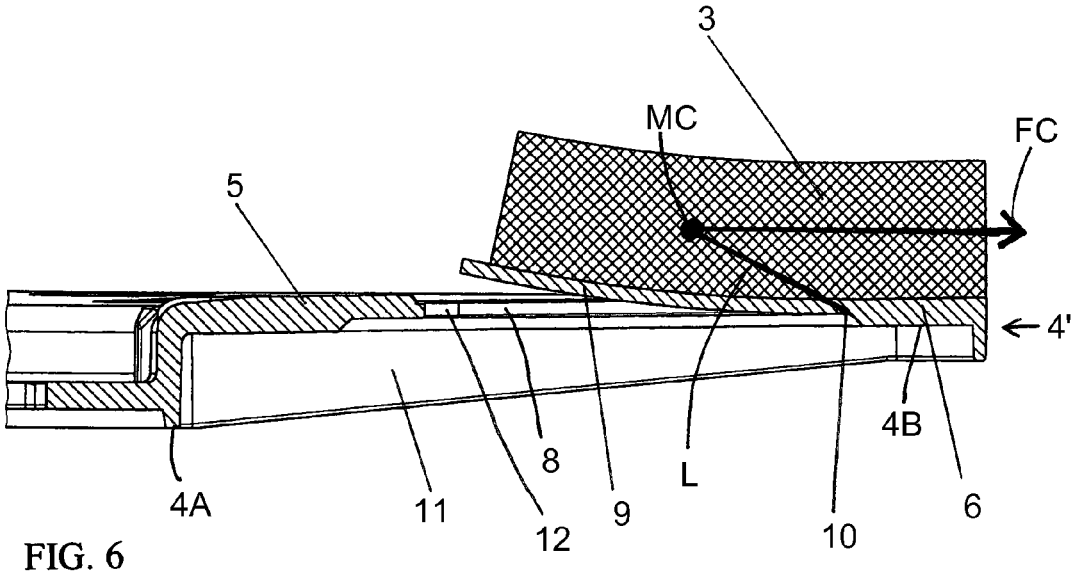
FIG. 6 is a sectional view similar to that of FIG. 5, but showing the pad and tongue-like tab in a deflected working or operating position while the floor care disk is rotating.

Similarly like the cut-outs 8, the tongue-like tabs 9 each also have a trapezoidal or truncated sector or pie-wedge shape and extend radially inwardly from the outer diameter range forming the radially outer region 6 toward the radially inner region 5. The tongue-like tabs 9 are each respectively flexible toward and away from the plane of the stiff disk element 4, and/or are respectively flexibly connected in a flexible hinge manner through a flexible tangential connection 10 to the radially outer region 6. Namely, the radially extending side edges of each tongue-like tab 9 are free and disconnected from the disk element 4, and the radially inner free end edge of each tongue-like tab 9 is free and disconnected from the disk element 4, thus leaving a free space gap 12 between the end and side edges of the tab 9 and the bounding edges of the cut-out openings 8, but the radially outer end of each tongue-like tab 9 is flexibly connected to the radially outer region 6 or circular rim 4B of the stiff disk element 4. This flexible connection can be a straight hinge joint extending tangentially to the circumferential direction, or can be a circumferentially curving hinge joint. This flexible connection 10 of each tongue-like tab 9 to the disk element 4, in the present embodiment, is formed by a step-like or tapering reduction of the material thickness of the tongue-like tab 9 transitioning from the circular rim 4B or radially outer region 6 of the disk element 4 (e.g. as shown in FIGS. 5 and 6).

Alternatively, instead of having the cut-outs 8, the disk element 4 can be a substantially solid, closed continuous disk element without such cut-out openings 8, or only with smaller openings which do not receive the tabs 9 therein. In that case, the tongue-like tabs 9 are arranged displaced out of the plane of the disk element 4, but rather extend parallel along the bottom surface of the disk element 4 and are connected by a flexible connection 10 onto the adjacent disk element 4 at the radially outer region 6 thereof.

The floor care pad 3 has an annular ring shape and is mounted on the drive plate 4', particularly on the radially outer region 6 or circular rim 4B of the disk element 4 as well as on the tongue-like tabs 9. While the disk element 4 and the tongue-like tabs 9, as well as the pad 3 mounted thereon, are stiff against torsional twisting in the rotational operation of the floor care machine, the centrifugal force acting on the pad 3 and the tongue-like tabs 9 during rotational operation causes the tongue-like tabs 9 and the portions of the pad 3 mounted thereon to be flexibly deflected away from the plane of the flexible connections 10 and toward the floor surface that is to be treated. In this regard, compare the stationary non-operating condition of FIG. 5 with the rotating operating condition of FIG. 6, where it can be seen that the tongue-like tab 9 and the portion of the pad 3 mounted thereon are being flexibly deflected away from the plane of the disk element 4 passing radially through the flexible connection 10, and toward the floor surface that is to be treated. Note that the sectional views of FIGS. 5 and 6 show the floor care disk 1 oriented "upside down" relative to the normal operating position in which the pad 3 would be oriented facing downwardly to contact the floor surface.

The tongue-like tabs 9 and the pad 3 are deflected as described above, because the common or overall center of mass MC of a respective tab 9 and the portion of the pad 3 mounted thereon lies displaced toward the floor surface away from the plane of the flexible connection 10. Therefore, when the floor care disk 1 rotates during operation, a bending moment is exerted on the flexible connection 10 due to the radially outwardly directed centrifugal force FC acting on the center of mass MC of the pad 3 and tongue-like tab 9 via a lever arm L.

At locations at which the pad 3 extends under the stiff portions of the disk element 4 away from the flexible tongue-like tabs 9, e.g. under the circular rim 4B and the spoke portions 7 of the disk element 4, the pad 3 will be correspondingly flexibly deformed to smoothly transition to the deflected portions of the pad 3 under the deflected tongue-like tabs 9. The overall effect is a good osculating contact and smooth adaptation of the pad areas of the pad 3 on the tongue-like tabs 9 against the floor surface that is to be treated. This achieves an easily reproducible floor treatment result, because the extent of deflection of the tongue-like tabs 9 and the pad 3 mounted thereon consistently corresponds to the rotational speed with which the pad is operated.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, wherein said floor care disk further comprises at least one floor care pad that is mounted on said drive plate so as to be adapted to come into contact with the floor surface, and wherein a respective one of said tongue-shaped tabs and a portion of said pad mounted on said respective tongue-shaped tab together have a center of mass located offset toward the floor surface from a radial plane passing through said connection of said respective tongue-shaped tab, so that a centrifugal force effective on said center of mass during the rotating of said floor care disk will exert a bending moment on said respective tongue-shaped tab toward the floor surface.

2. The floor care disk according to claim 1, wherein said floor care pad is mounted on said radially outer portion of said disk element and on said tongue-shaped tabs.

3. The floor care disk according to claim 2, wherein said floor care pad has an annular ring shape with a central opening in registration with said radially inner portion of said disk element.

4. The floor care disk according to claim 1, wherein each one of said connections is a flexible connection formed of an elastically flexible synthetic plastic.

5. The floor care disk according to claim 1, wherein at least said tongue-shaped tabs are formed of an elastically flexible synthetic plastic.

6. The floor care disk according to claim 1, wherein said disk element has openings therein between said radially inner portion and said radially outer portion, and said tongue-shaped tabs are respectively arranged in said openings.

7. The floor care disk according to claim 6, wherein an open gap space remains between free edges of each respective one of said tongue-shaped tabs and surrounding edges of said disk element bounding a respective one of said openings in which said respective tongue-shaped tab is arranged.

8. The floor care disk according to claim 1, wherein said tongue-shaped tabs are arranged offset away from a radial plane of said stiff disk element and are mounted on a bottom surface of said stiff disk element facing toward the floor surface.

9. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, and wherein each one of said connections is a respective hinge connection with a hinge pivot axis extending tangentially to a circumferential direction.

10. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, and wherein each one of said connections is a respective flexible connection formed by a respective step-shaped or sloped tapering reduction of material thickness at a transition from said radially outer portion of said disk element to a respective one of said tongue-shaped tabs.

11. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, and wherein said drive plate is an integral monolithic one-piece component including said disk element, said tongue-shaped tabs and said connections, which are all together integrally formed as said one-piece component of a single monolithic material.

12. The floor care disk according to claim 11, further comprising a floor care pad mounted on a bottom of said drive plate so as to be adapted to come into contact with the floor surface, and wherein said tongue-shaped tabs are arranged below a bottom surface of said stiff disk element between said stiff disk element and said floor care pad.

13. The floor care disk according to claim 12, wherein said stiff disk element does not have openings that receive said tongue-shaped tabs therein.

14. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, and wherein each respective one of said tongue-shaped tabs respectively has a trapezoid shape, with a connected base edge formed by one of said connections at a radially outer end of said respective tongue-shaped tab, a free end edge at a radially inner end of said respective tongue-shaped tab, and two free side edges extending along sides of said trapezoid shape from said connected base edge to said free end edge.

15. A floor care disk for a floor care machine that is adapted for rotating said floor care disk contacting on a floor surface so as to treat the floor surface, wherein said floor care disk comprises a drive plate, which comprises a stiff disk element and plural tongue-shaped tabs that are connected by respective connections to a radially outer portion of said disk element and that respectively extend from said connections radially inwardly toward a radially inner portion of said disk element, wherein said tongue-shaped tabs are flexible or said connections are flexible or both said tongue-shaped tabs and said connections are flexible so that said tongue-shaped tabs are deflectable away from a radial plane of said disk element toward the floor surface during the rotating of said floor care disk, wherein said radially inner portion of said disk element comprises a disk hub configured to be mounted on a rotatable drive shaft, spindle or arbor of the floor care machine, wherein said radially outer portion of said disk element comprises a circular rim, and wherein said disk element further comprises radially extending spokes that extend between and interconnect said radially inner portion and said radially outer portion of said disk element, with open areas respectively between successive ones of said spokes in a circumferential direction.

16. A floor care disk for a floor care machine that is adapted for rotating said floor care disk contacting on a floor surface so as to treat the floor surface, wherein:

said floor care disk comprises a drive plate and a floor care pad mounted on a bottom of said drive plate so as to be adapted to come into contact with the floor surface, said drive plate comprises a relatively stiff disk element including a radially inner central hub, a radially outer circular annular rim, and radially extending spokes that connect said rim with said hub and that leave open spaces respectively between successive ones of said spokes in a circumferential direction and between said hub and said rim in a radial direction, said drive plate further comprises plural relatively flexible tongue-shaped tabs, which are respectively arranged in said open spaces, and which are respectively flexibly connected by respective flexible connections to said rim, and which respectively extend from said flexible connections radially inwardly in said open spaces toward said hub, and which are flexibly deflectable in a direction away from a radial plane of said disk element toward said floor care pad, said floor care pad is mounted on said rim and on said tongue-shaped tabs, and a respective one of said tongue-shaped tabs and a portion of said pad mounted on said respective tongue-shaped tab together have a center of mass located offset toward the floor surface from a radial plane passing through said flexible connection of said respective tongue-shaped tab, so that a centrifugal force effective on said center of mass during the rotating of said floor care disk will exert on said respective tongue-shaped tab about said flexible connection thereof a bending moment toward the floor surface.

* * * * *